US009980866B2

(12) United States Patent
Møller

(10) Patent No.: US 9,980,866 B2
(45) **Date of Patent: *May 29, 2018**

(54) EQUIPMENT FOR THE RAISING OF A LYING PERSON

(71) Applicant: Liftup A/S, Støvring (DK)

(72) Inventor: Anders Lykkegaard Møller, Sønderborg (DK)

(73) Assignee: LIFTUP A/S, Støvring (DK)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/387,286

(22) Filed: Dec. 21, 2016

(65) Prior Publication Data

US 2017/0100292 A1 Apr. 13, 2017

Related U.S. Application Data

(63) Continuation of application No. 14/437,446, filed as application No. PCT/DK2013/000071 on Oct. 23, 2013, now Pat. No. 9,561,144.

(30) Foreign Application Priority Data

Oct. 23, 2012 (DK) ..... 2012 00651

(51) Int. Cl.
*A47C 13/00* (2006.01)
*A47C 1/00* (2006.01)
(Continued)

(52) U.S. Cl.
CPC ..... *A61G 5/14* (2013.01); *A61G 1/003* (2013.01); *A61G 1/013* (2013.01); *A61G 1/017* (2013.01);
(Continued)

(58) Field of Classification Search
CPC ..... A61G 1/013; A61G 1/017; A61G 7/1011; A61G 7/1088; A61G 7/109; A61G 7/1074; A61G 7/1038
(Continued)

(56) References Cited

U.S. PATENT DOCUMENTS 2,394,245 A 6/1942 Koller
3,137,511 A 6/1964 Weil et al.
(Continued)

FOREIGN PATENT DOCUMENTS

CN 101816601 A 9/2010
CN 201684092 U 12/2010
(Continued)

OTHER PUBLICATIONS

International Search Report for PCT/DK2013/000071 dated Mar. 4, 2014.

*Primary Examiner* — Rodeny B White
(74) *Attorney, Agent, or Firm* — Knobbe, Martens, Olson & Bear, LLP

(57) ABSTRACT

Equipment for raising of a lying person. The equipment comprises: a seat (1), a backrest (2), which from a first position can be passed to a second position behind the back of the person, and a chassis (3) with an upper end to which the seat is connected and a lowermost end adapted to rest on a surface such as a floor. The equipment is to be placed on the surface positioned to the person such that the seat is placed under the behind of the person and from this first position the equipment with the person can be passed to a second position in which the chassis with its lower end rests on the surface such that the seat and backrest is raised relative to the surface e.g. to take a chair-like posture or a catapult position i.e. an upright position in which the person will be assisted to a standing position.

9 Claims, 4 Drawing Sheets

Figure 1:
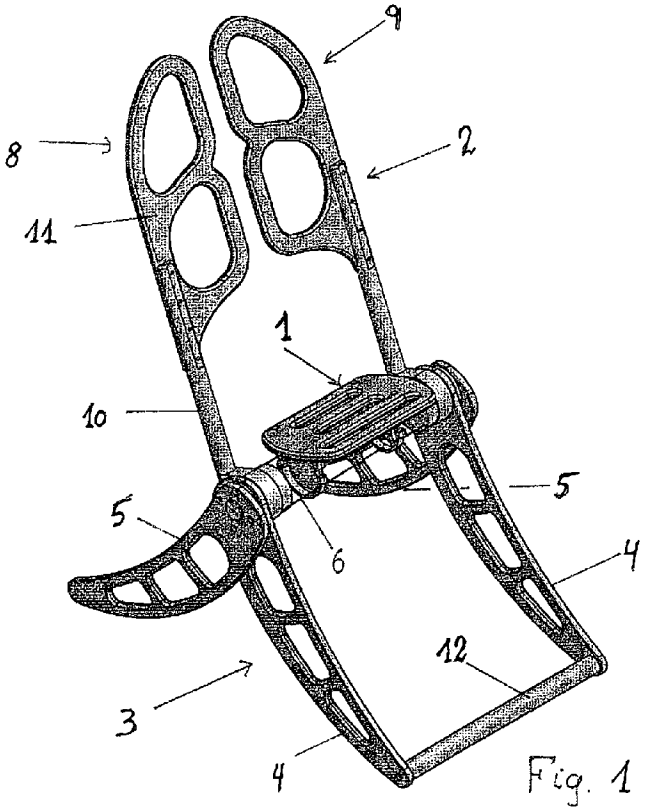

(51) Int. Cl.

| | |
|---|---|
| ***A61G 5/00*** | (2006.01) |
| ***A61G 5/04*** | (2013.01) |
| ***A61G 5/08*** | (2006.01) |
| ***A61G 5/14*** | (2006.01) |
| ***A61G 7/10*** | (2006.01) |
| ***A61G 7/16*** | (2006.01) |
| ***A61G 1/003*** | (2006.01) |
| ***A61G 1/013*** | (2006.01) |
| ***A61G 1/017*** | (2006.01) |

(52) U.S. Cl.
CPC ..... *A61G 7/109* (2013.01); *A61G 7/1011* (2013.01); *A61G 7/1038* (2013.01); *A61G 7/1074* (2013.01); *A61G 7/1088* (2013.01)

(58) Field of Classification Search
USPC ..... 297/52, 118, 330; 5/81.1 R, 83.1, 87.1
See application file for complete search history.

(56) References Cited

U.S. PATENT DOCUMENTS

| | | | | |
|---|---|---|---|---|
| 3,271,796 | A | 9/1966 | Dillman | |
| 3,921,231 | A | 11/1975 | Bourgraf et al. | |
| 4,173,372 | A | 11/1979 | Norris | |
| 4,249,774 | A | 2/1981 | Andreasson | |
| 4,393,529 | A | 7/1983 | Britz | |
| 4,432,359 | A | 2/1984 | James | |
| 4,987,620 | A | 1/1991 | Sharon | |
| 5,023,968 | A | 6/1991 | Diehl | |
| 5,096,008 | A | 3/1992 | Mankowski | |
| 5,193,633 | A | 3/1993 | Ezenwa | |
| 5,355,538 | A | 10/1994 | Fulford | |
| 5,572,756 | A | 11/1996 | Muuranen | |
| 5,896,602 | A | 4/1999 | Marblestone | |
| 6,131,215 | A | 10/2000 | Lindell | |
| 6,154,899 | A | 12/2000 | Brooke | |
| 6,336,235 | B1 | 1/2002 | Ruehl | |
| 6,381,781 | B1 | 5/2002 | Bourgraf | |
| 6,427,270 | B1 | 8/2002 | Blevins | |
| 6,691,349 | B2 | 2/2004 | Blevins | |
| 6,834,402 | B2 | 12/2004 | Hanson | |
| D518,303 | S | 4/2006 | Vira | |
| 7,578,012 | B2 | 8/2009 | Palay | |
| 7,740,309 | B2 | 6/2010 | Mayercheck | |
| 8,316,480 | B2 | 11/2012 | Burak, Jr. | |
| 9,021,633 | B2 | 5/2015 | Chun | |
| 9,084,707 | B2 | 7/2015 | Patterson | |
| 9,561,144 | B2 * | 2/2017 | Moller | A61G 1/003 |
| 2007/0028381 | A1 | 2/2007 | Palay | |
| 2018/0028377 | A1 * | 2/2018 | Stryker | A61G 1/017 |
| 2018/0042791 | A1 * | 2/2018 | Eriksen | A61G 1/003 |

FOREIGN PATENT DOCUMENTS

| | | | |
|---|---|---|---|
| EP | 0 707 843 | A1 | 10/1995 |
| GB | 2 413 953 | A | 11/2005 |
| JP | 2002-17785 | A | 1/2002 |
| JP | 2007-159764 | | 6/2007 |
| JP | 2008154948 | | 7/2008 |
| WO | WO 02/15834 | A1 | 2/2002 |
| WO | WO 2010/096636 | A1 | 8/2010 |

* cited by examiner

EQUIPMENT FOR THE RAISING OF A LYING PERSON

This application is a continuation of U.S. patent application Ser. No. 14/437,446, filed on 21 Apr. 2015, now U.S. Pat. No. 9,561,144 B2, which claims the benefit and priority to and is a U.S. National Phase Application of PCT International Application No. PCT/DK2013/000071, filed on 23 Oct. 2013, designating the United States of America and published in the English Language on 1 May 2014, as WO 2014/063705, which is an international application of and claims the benefit of priority to Denmark Patent Application No. PA 2012 00651, filed on 23 Oct. 2012, each of which is hereby incorporated by reference in its entirety.

The invention relates to an equipment which can be used to raise a person lying on a solid surface such as a floor.

The invention is based on the difficulty related to raise an elderly person or a person with reduced mobility that has fallen on a floor. In particular it concerns persons who are physically weakened and do not have sufficient muscles to rise to their feet by their own, or where it will cause consequential damages if the person is trying to get up without assistance. Here it concerns people who basically are vigorous , and for unknown reasons have a fall or stumble across a piece of furniture or something else. Persons falling over due to a heart attack are another matter. Due to inadequate muscles and resilience of the body the person will appear with a "dead weight", and it will be difficult even for the nursing staff to raise the person. At the same time it should be considered that the raising of the person must not cause consequential damages. Here is among others persons who suffer from osteoporosis in mind, where it will be necessary to be careful such that they are not exposed to a bone fracture during the attempt of raising them. Equipment such as lifts for handling of physically weakened persons is known. It can be crane-like lifts running on wheels or ceiling lifts, where the lift is running on a rail fixed in the ceiling or to a special frame. However, these lifts are not particularly practicable to raise a person who has fallen on the floor.

The purpose of the invention is to provide an equipment which is suitable for the raising of a person who has fallen or is lying down for other reasons.

According to the invention this is achieved with an equipment as defined in claim 1, and which comprises a seat and a backrest, which from a first position can be passed to a second position behind the back of the person as well as a chassis with an upper end to which the seat is connected and a lowermost end adapted to rest on a surface such as a floor, where the chassis from a first position can be passed to a second position in which the chassis with its lower end rests on the surface such that the seat and backrest is raised relative to the surface. The equipment should be positioned to the person such that the seat is placed under the behind of the person and the backrest is placed under the back of the person. Upon activation of the chassis the seat and the backrest are moving upwards carrying the person. The given situation determines to which height the person is to be raised to, the equipment can be positioned to take a chair-like position, such that the person takes a sitting position or the equipment can be raised further to what is known as a catapult position, i.e. an upright position in which the person will be assisted to a standing position. Another great advantage of the equipment is that it can be designed to take up a minimum of space when it is used as well as it can be designed to take up a minimum of extra space during use.

Further characteristics of the invention appear from the claims 2-15 and the following description of an embodiment of the equipment according to the invention.

Figure 2:
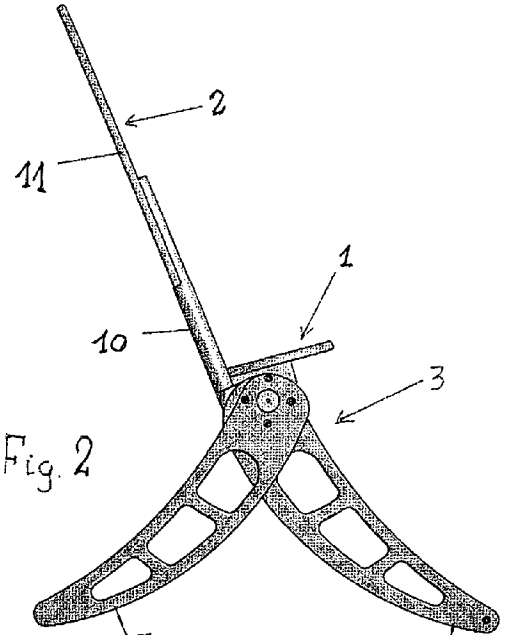
Figure 3:
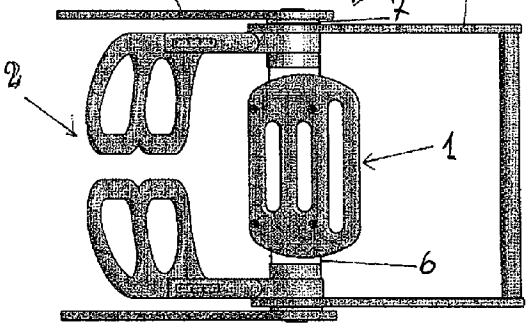

An embodiment of the equipment according to the invention will now be described in details with reference to the accompanying drawings, in which FIG. 1, shows the equipment in a perspective view from the side/front, FIG. 2, shows the equipment directly from one side, FIG. 3, shows the equipment viewed directly from above, and FIGS. 4-11, show a series of images of the equipment in various stages during use.

As it appears from the drawing the main components of the equipment are a seat 1, a backrest 2 and a chassis 3.

The chassis 3 comprises on each side a first leg 4 and a second leg 5, where the first leg 4 on each side is attached to the end of a through travers 6, comprising a drive unit. The second leg 5 is mounted on a bracket 7 at the end of the drive unit. The seat 1 is mounted on the through travers 6. The backrest 2 consists of two separate parts 8,9. The parts 8,9 comprise a shaft 10 which with one end is rotatable embedded in the through travers 6. At the other end of the shaft 10 there is a backrest member 11.

Figure 4:
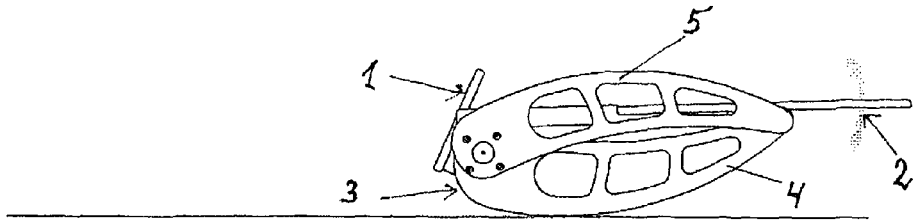
Figure 5:
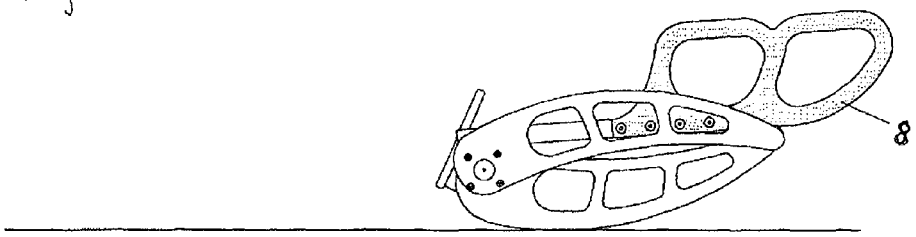
Figure 6:
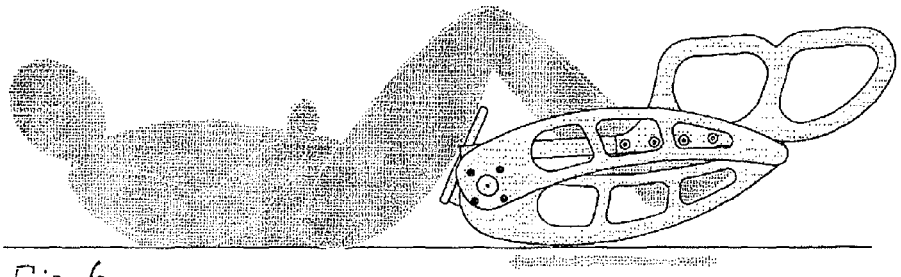
Figure 7:
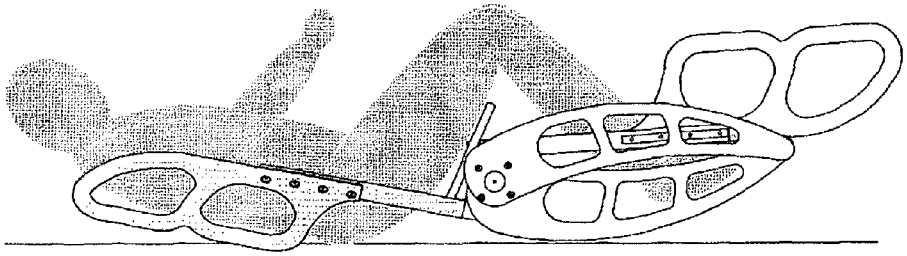
Figure 8:
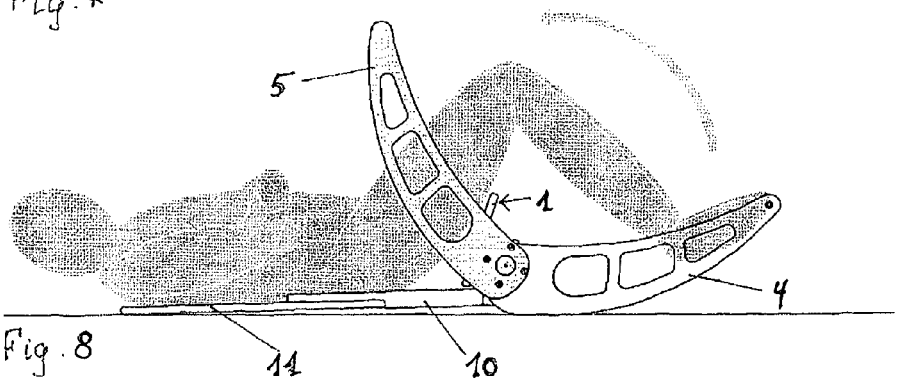
Figure 9:
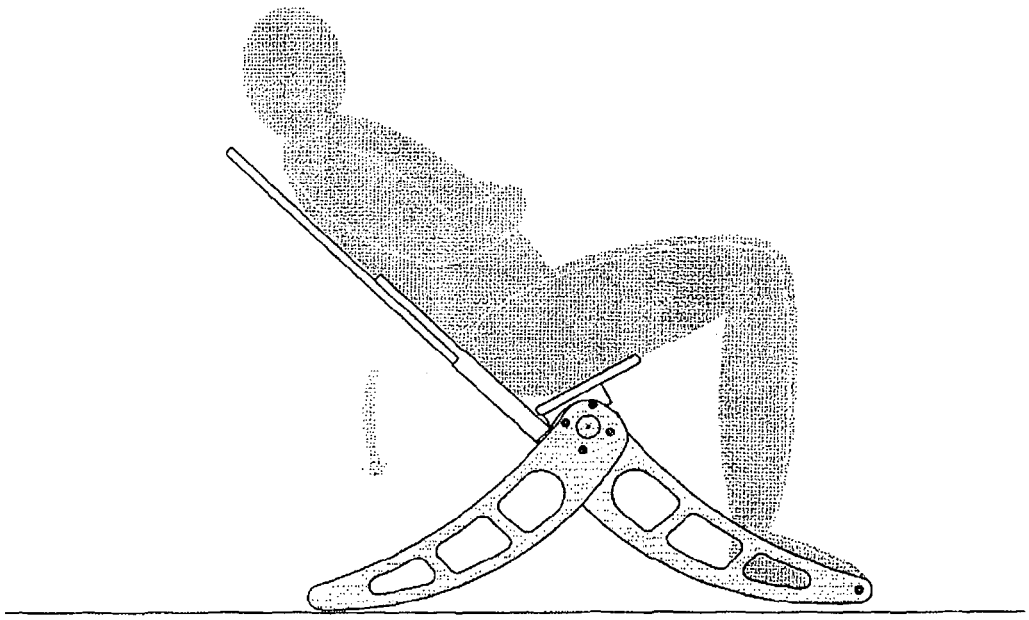
Figure 10:
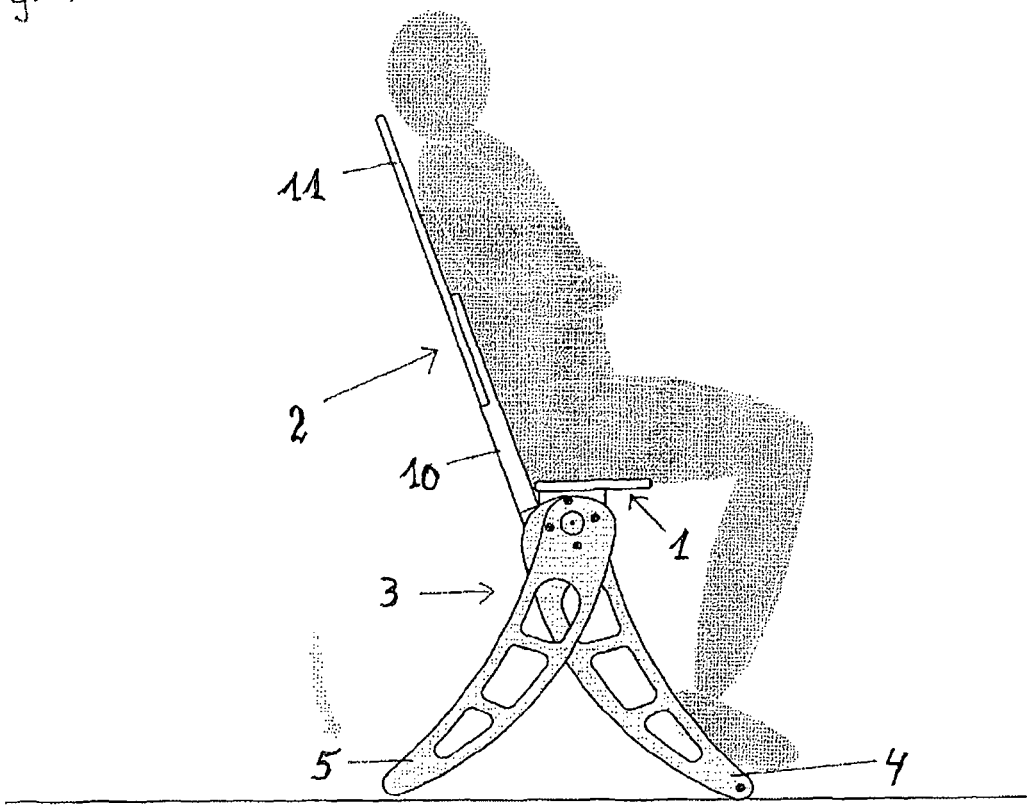
Figure 11:
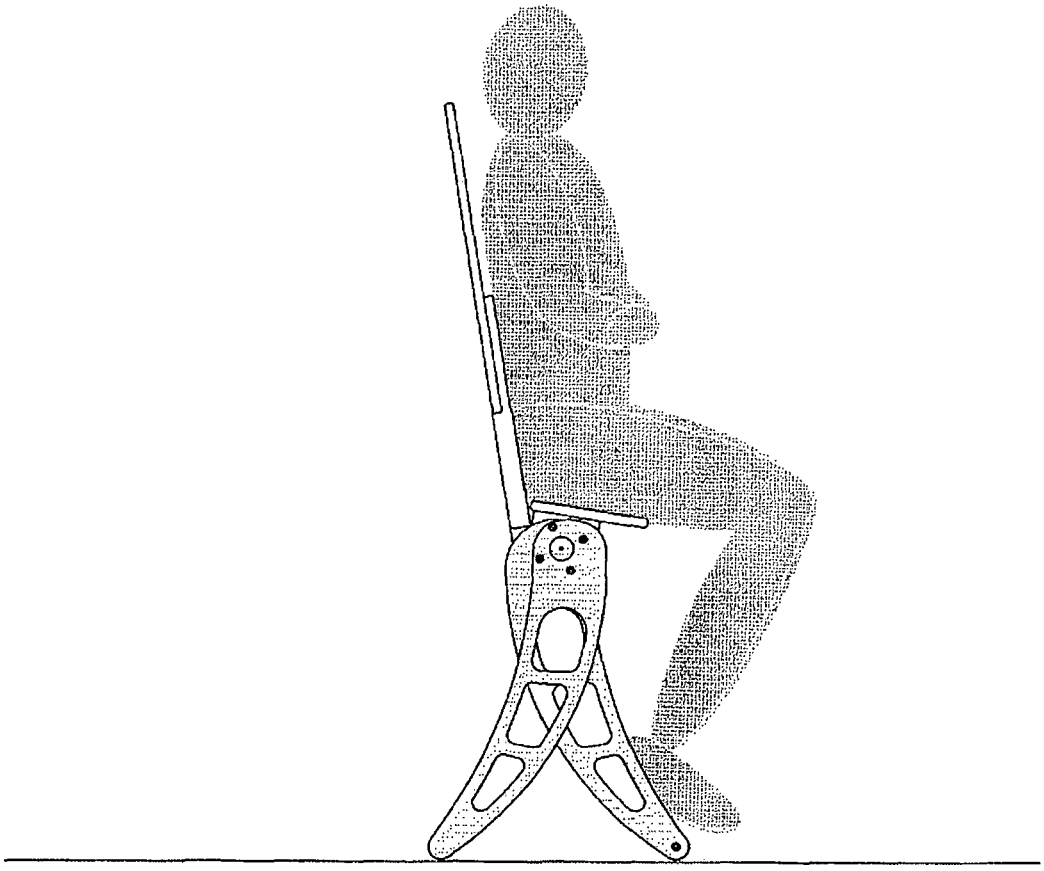

In FIG. 4 the equipment is shown in a collapsed position lying en a surface. In FIG. 5 the parts 8 of the backrest are turned such that the backrest member 11 is in a vertical position. In FIG. 6 the equipment is pushed down under the legs of a person lying on the surface such that the seat 1 rests against the behind of the person. In FIG. 7 one part 8 of the backrest is rotated to a position such that it is located along the side of the person, and in FIG. 8 the part 8 of the backrest is rotated such that the backrest member 11 is positioned behind the back of the person. This is to be repeated with the second part 9 of the backrest. Both parts 8,9 of the backrest can of course be moved at the same time. Alternatively, the two parts 8,9 of the backrest can be interconnected by a shaft such that they move synchronously. However, It should be noted that the backrest members 11 of the two parts 8,9 are moved individually. The person now rests in the equipment. As is appears from FIG. 8 the other leg 5 of the chassis is now rotated along the person and by the further rotation the extremity of the second leg 5 will get into contact with the ground and will with the free end begin to lift upwards the end of the first leg 4 together with the travers 6, the seat 1 and the backrest 3, as the two legs 4,5 is performing a scissor movement until the equipment has assumed a posture as a chair, and thus has raised the person to a sitting position. When the two legs 5 are moved further the equipment will be able to raise the person to a standing position as shown in FIG. 11, also known as "a catapult operation".

It is important to note that the equipment can be stopped and reversed at any time. It may be relevant if it turns out or one suspects that the person has broken for example a leg or an arm during his fall. It might simply also be the case that the person needs a little break during the movement to the raised position.

When the equipment is to be folded after use, the first legs 4 are activated such that it continues to rotate in the same direction until the equipment again appears as shown in FIG. 4.

The two parts 8,9 of the backrest can be locked at least in the position in which they with their backrest member 11 are turned behind the back of the person. The lock can simply be a ball lock. Preferably, the backrest sections 8,9 can also be locked when the equipment is folded, which partly contributes to a precise operation of the equipment, and at the same time is improving the operation as the equipment can be carried and maneuvered in relation to the person by means of the backrest. As it appears from FIG. 4 the backrest members 11 of the backrest extend in the front of the legs 4,5. However the backrest members 11 can be mounted axially displaceable on the shafts 10 and in that way they can be pushed in such that they do not extend or do not extend as much in front of the legs 4,5, when the equipment is folded.

The first leg 4 on each side of the equipment can be connected to a cross member 12 at their lower ends. This contributes to greater stability of the equipment, likewise the cross-member 12 can be exploited during use of the equipment in that the operator of the equipment can support with a foot on the cross member 12. For supporting of the lying person's legs an additional cross member can be mounted upon which the lying person can rest with the back of his ankles.

The drive unit for the second leg 5 on each side of the chassis may consist of two separate electric servomotors. The through travers 6 can be a pipe in which the servomotors are arranged at each ends. The power supply for the servo motors can be rechargeable batteries, which together with a control can be located inside the travers. The operating device can merely be of a simple on/off switch. Alternatively, the drive unit can comprise a single motor which via the shaft drives the second leg 5 on each side of the chassis. It can be a single through shaft or two shafts, one for each of the two legs 5. The electric motor can drive the shaft/shafts via a gear with spur gears, where the motor is placed parallel to the shaft/shafts or the gear may comprise a bevel gear, such that the motor is placed perpendicular to the traverse 6. Another possibility is to use multiple servo motors which are arranged along the drive shaft. This makes it possible to use smaller servo motors such that the drive unit does not become that bulky and finds better space under the seat. A further possibility is to use a "hollow"motor, i.e. an electric motor with a through shaft which drives each of the legs. The drive unit can also be designed to be operated manually, for example with a hand crank in case of power failure. Furthermore, the drive unit can be designed such that the electric servo motor is disengaged when the handle is mounted. This may, for example be achieved in that a gear wheel in the gear mechanism is spring loaded to engage and when the hand crank is mounted the gear wheel is disengaged by pushing it back against the spring load. Alternatively, the drive unit can be designed to be operated with a crank handle only, which furthermore can be a hand wheel. In principle, the equipment could also be manually raised to the chair-like posture e.g. in that it is equipped with a lever handle or lifting straps. However, the motorized version is recognized to be the most gentle for the person to be assisted as a motor drive will have a smooth movement of the equipment without sudden jerks and shocks that could damage the person. Furthermore, it will also be physically hard for the assistants to rais the equipment with the person manullay.

The seat 1 can be secured to the travers 6 directly by screws or indirectly by brackets. For example it can be brackets in the shape of pipe brackets that are clamped around the travers 6.

The outer free end of the legs 4,5 can be provided with drive wheels or rollers such that the person can be wheeled on the equipment, for example to a chair or a bed. For operation of the equipment and for safety reasons, at least one of the drive wheels can be locked. Preferably, both wheels on the first legs 4 are lockable. When the second leg 5 on each side of the chassis is provided with drive wheels or rollers these are running across the underlying surface rather than sliding, which requires less effort and energy. This means one can choose a smaller motor and that the rechargeable batteries last longer.

As it appears the legs 4,5 are performed slightly curved, which in itself causes a smooth movement of the legs 4,5 across the surface. However, the edges of the legs 4,5, which comes into contact with the surface can be provided with wheels or rollers such that friction will be decreased when the legs are moved across the surface.

As is appears, the equipment consists of relatively few components, e.g. are the four legs basically identical and the same applies to the two parts of the backrest. The equipment can be manufactured in a variety of materials, e.g. the legs, the seat and the backrest can be manufactured from wood. It is of course also possible to manufacture the equipment in a plastic material, for example a carbon fiber material or metal or a combination of materials.

As it also appears from the drawing the equipment takes up only a small space in the collapsed condition, c.f. FIG. 4. As it also apparent there is only required a minimum of surrounding space for operating the equipment. Basically there is not required more space than a person is occuping.

The invention claimed is:

1. Equipment for raising a lying person, the equipment comprising:

a chassis, the chassis comprising a first pair of legs fixedly coupled to both sides of a transverse rod and a second pair of legs movably coupled to both sides of the transverse rod, the second pair of legs movable with respect to the first pair of legs;

a seat mounted on the transverse rod, the legs extending away from the seat and the transverse rod;

a backrest movable from at least a first position to a second position behind the back of the person, the chassis configured to move the seat and the backrest from a first position where the backrest contacts the floor to a second position where the seat and backrest are raised relative to the floor in comparison to the first position;

the chassis including at least one electric motor configured to rotate the second pair of legs about the transverse rod towards the first pair of legs performing a scissor movement to raise the seat and the backrest from the first position.

2. The equipment according to claim 1, wherein a power supply for the electric motor comprises rechargeable batteries, which together with a control, are located inside the transverse rod.

3. The equipment according to claim 1, wherein the first and second pairs of legs are at least partially curved.

4. The equipment according to claim 1, wherein the backrest consists of two separate parts arranged on each side of the transverse rod.

5. The equipment according to claim 4, wherein the two parts of the back support comprise a shaft having a backrest member which, from a neutral position, can be turned on and locked behind the back of the person to be raised from the ground.

6. The equipment according to claim 1, wherein two separate electric servomotors are configured to rotate the second pair of legs about the transverse rod.

7. The equipment according to claim 6, wherein the transverse rod is cylindrically shaped and wherein the servomotors are placed at each end, and furnished with a power supply and a control.

8. The equipment according to claim 1, wherein the equipment comprises one electric motor positioned perpendicular to the transverse rod.

9. The equipment according to claim 1, wherein the equipment includes a lever handle or lifting straps for manually raising of the equipment.

* * * * *